United States Patent [19]

Keller et al.

[11] 4,123,686

[45] Oct. 31, 1978

[54] ION GENERATING SOURCE

[75] Inventors: Roderich Keller, Darmstadt; Michael Müller, Mannheim, both of Fed. Rep. of Germany

[73] Assignee: Gesellschaft für Schwerionenforschung mbH, Darmstadt, Fed. Rep. of Germany

[21] Appl. No.: 774,655

[22] Filed: Mar. 4, 1977

[30] Foreign Application Priority Data

Mar. 11, 1976 [DE] Fed. Rep. of Germany ..... 2610165

[51] Int. Cl.[2] ..... H01J 27/00

[52] U.S. Cl. ..... 313/230; 313/153; 313/231.4

[58] Field of Search ..... 313/230, 153, 359, 231, 313/231.4

[56] References Cited

U.S. PATENT DOCUMENTS 3,702,416 11/1972 Bex et al. ..... 313/230 X

*Primary Examiner*—Rudolph V. Rolinec
*Assistant Examiner*—Darwin R. Hostetter
*Attorney, Agent, or Firm*—Spencer & Kaye

[57] ABSTRACT

A source for generating singly and/or multiply charged ions composed essentially of a glow cathode, an intermediate electrode and an anode electrode having a common axis of symmetry and bordering a gas discharge chamber and each presenting a passage opening coaxial with the axis of symmetry, and a system producing a magnetic field having an axial component along the axis of symmetry, with the anode electrode opening being at a location where the magnitude of the axial component of the magnetic field is substantially equal to its maximum value.

10 Claims, 5 Drawing Figures

ION GENERATING SOURCE

BACKGROUND OF THE INVENTION

The present invention relates to a source for generating singly and/or multiply charged ions, of the type including a glow cathode, an intermediate electrode and an anode having passage openings and defining a gas discharge chamber in which electrons and/or auxiliary gas ions form the ions, the source further being provided with a magnetic yoke which produces a magnetic field along a common axis of symmetry of the intermediate electrode and the anode.

Ions beams with energies above about 30 keV are often used in physical research, such as, for example, for particle accelerators used for research into atomic and nuclear physics principles, or for examining radiation damage in connection with reactor construction, or for biomedical uses, and in the ion implantation art to produce semiconductor devices. The amount of equipment required to accelerate multiply charged ions is substantially less than for singly charged ions. The high frequency accelerators used in high energy physics even require ions with a quite specific minimum charge so that sources for highly charged ions are very important.

A source is known, which is called a duoplasmatron ion source described in UNILAC Project Reports Nos. 8 and 9, (1973), available by Gesellschaft of Schwerionenforschung m.b.H., Darmstadf, Fed. Rep. of Germany, in which the energy of the ionizing primary electrons is limited due to the characteristics of the discharge structure so that an upper limit is placed on the realizable number of ion charges for each element.

SUMMARY OF THE INVENTION

It is therefore an object of the present invention to produce intensive radiation ($\phi > 10^{12}$ particles/sec) of highly charged ions of any desired element in a continuous sweep operation or in pulsed operation with high keying ratios ($\geqq 10\%$) for use in particle accelerators for physical research as well as for industrial and biomedical applications, where a constant radiation, with respect to time, of ions of the specific charge $>0.046$ $e_o/M_o$ is to be maintained over a period of at least 20 hours.

This and other objects are accomplished according to the present invention by disposing the passage opening of the anode in the area of the maximum amplitude of the axial component of the magnetic field. In an advantageous manner, the area of the anode around the passage opening may then be disigned as an anode shield, may be made of nonmagnetic material and may be constructed to be coolable.

According to one embodiment of the invention, the anode shield is composed of at least two parts which are each replaceable. Moreover, it is possible, in a modified embodiment of the source according to the invention, to arrange a cylinder of a high melting point, nonmagnetic material to surround the passage opening of the intermediate electrode. In this way the shape of the electrode in the source permits the realization of desired discharge conditions without requiring a change in the magnetic configuration.

In a further embodiment of the source according to the invention, in which ionization material can reach the plasma of an auxiliary gas by means of solid-state body atomization with ion bombardment, or sputtering, a sputter electrode can be placed in the gas discharge area between the intermediate electrode and the anode, the passage opening of this sputter electrode lying on the axis of symmetry of the intermediate electrode and anode. The sputter electrode is made of nonmagnetic material and is provided around its passage opening with a cylinder of the material to be sputtered.

The sputter electrode is designed so that it fills the major part of the gas discharge chamber, forms part of the magnetic yoke itself with an outer ring of magnetic material and is electrically separated from the intermediate electrode and the anode by means of insulation discs.

In order to exceed the threshold excitation energies of the highly charged ions to be produced, the source is operated at higher discharge voltages, i.e. $>200$ V, which would normally increase the discharge energy to above the destruction limit of the anode shield. However, the use according to the present invention of a cylinder of a high melting point, nonmagnetic metal together with a small diameter bore in the intermediate electrode, the bore being selected according to the particular operating gas involved, raises the plasma resistance to such an extent that the discharge current and thus the discharge energy remain within permissable limits and the configuration of the magnetic field remains uninfluenced thereby.

DESCRIPTION OF THE PREFERRED EMBODIMENTS

Figure 1:
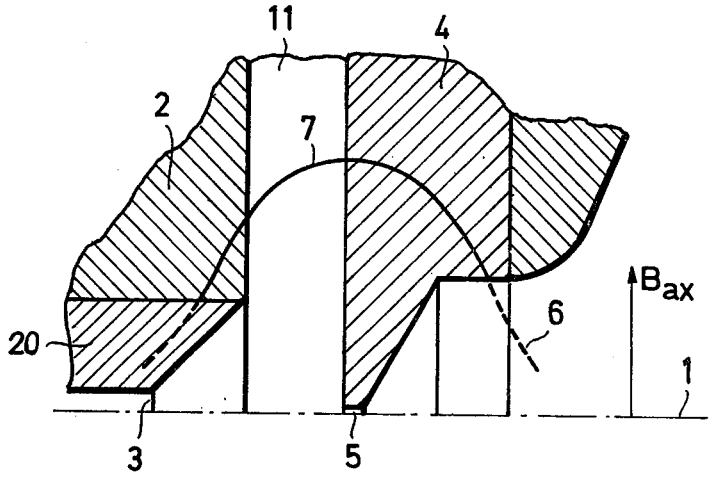
FIGS. 1 and 2 are schematic cross-sectional, detail views of portions of two embodiments of gas discharge chambers according to the invention.

FIG. 1 illustrates part of an intermediate electrode insert 2 having an insert 20 defining a passage opening 3 and part of an anode shield 4 presenting a passage opening 5, all located in an anode, or discharge, chamber 11, the entirety of each element being symmetrical about the axis of symmetry 1 of the source arrangement. Curve 6 depicts the variation, along axis 1, of the axial component of the magnetic flux density $B_{ax}$ in relative units. Curve 6 has a distinct maximum 7 at which the passage opening 5 through anode shield 4 is directly disposed.

Figure 2:
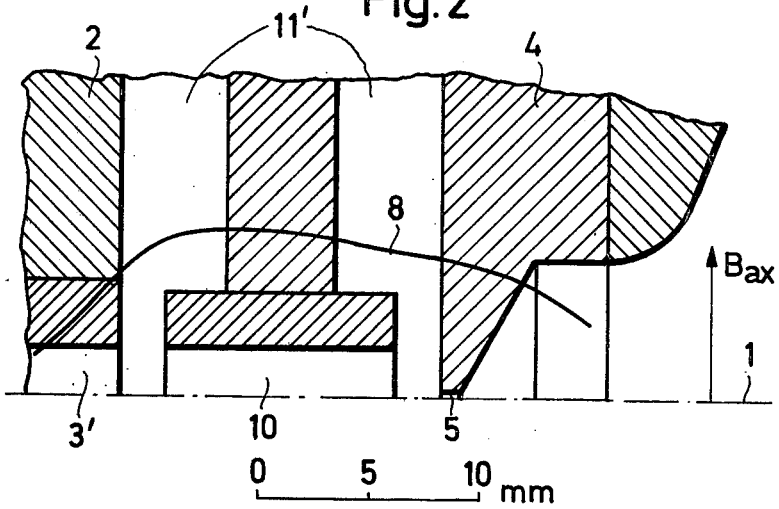

FIG. 2 also shows, by curve 8, the variation along axis 1 of the axial component of the magnetic flux density in relative units in a second embodiment of the source according to the invention. The magnetic flux density reaches its maximum value approximately at the location of the intermediate electrode insert 2 with its passage opening 3' and remains almost constant to a point past anode passage opening 10. Thus, maximum axial magnetic flux density prevails throughout almost the entire anode chamber 11'.

The variation characteristic of the magnetic flux density shown in FIGS. 1 and 2 prevents the occurrence of plasma instabilities and thus permits operation of the source at discharge conditions required for the generation of highly charged ions. Each of FIGS. 1 and 2 illustrates a preferred embodiment in which all dimensions are accurately drawn to the scale shown in FIG. 2.

Figure 3:
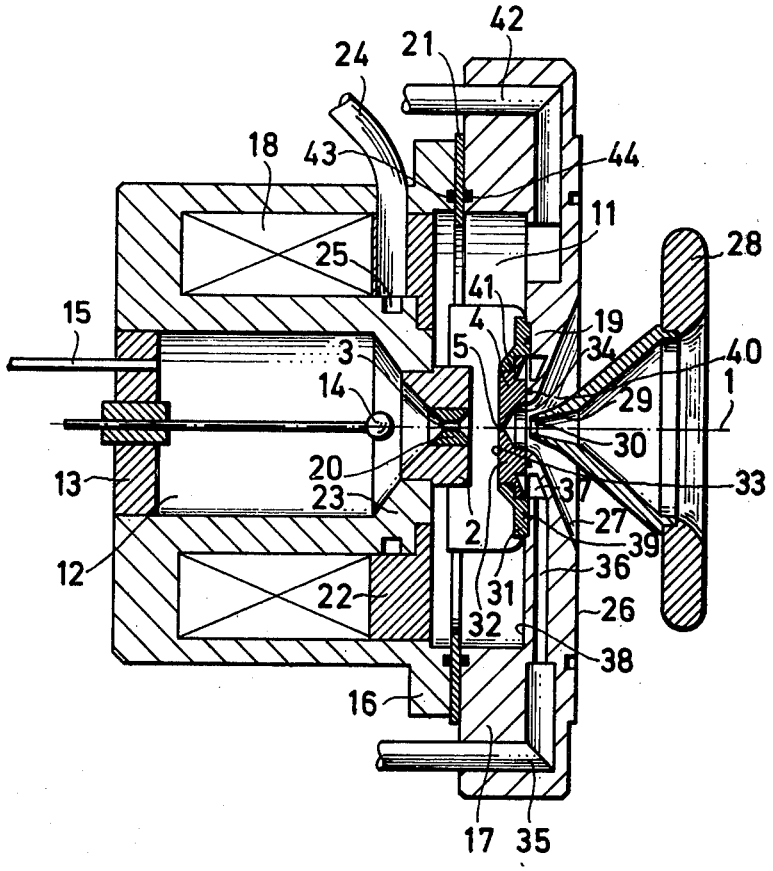
FIG. 3 is a cross-sectional view of an embodiment of the invention without a sputter electrode.

FIG. 3 illustrates an embodiment of a source according to the invention in which there is no sputter electrode corresponding in structure to the showing in FIG. 1. Part of the source is formed by a cathode chamber 12 which is likewise axially symmetrical to the axis of symmetry 1. Cathode chamber 12 is substantially axially enclosed by intermediate electrode 2 and a cover plate 13 and the voltage leads for the actual cathode 14 pass through cover plate 13 in an insulated manner. A gas inlet 15 leads into cathode chamber 12.

Cathode chamber 12 is enclosed laterally by the inner portion of a magnetic yoke 16. The entire magnetic yoke, including parts 16 and 17, encloses discharge chamber 11 and a magnetic coil 18, which produces a magnetic field along the axis of symmetry 1, is disposed within part 16. The frontal face 19 of magnetic yoke 17 constitutes the pole piece at the anode side while the intermediate electrode insert 2 forms the intermediate electrode pole piece. The intermediate electrode insert 2, as well as insert 20 surrounding the passage opening 3, extend into gas discharge chamber 11. The magnetic yoke part 17 is electrically insulated from magnetic yoke part 16 by an insulating disc 21. Moreover, magnet coil 18 is insulated from the gas discharge chamber 11 by a disc 22 of nonmagnetic material. The inner portion 23 of magnetic yoke 16 is water cooled via inlet line 24 and water passage ring 25.

An extraction electrode 28 is disposed opposite the one frontal face 26 of magnetic yoke part 17, face 26 being formed to have a conical recess 27. In particular, the tip 29 with its opening 30, which is also axially symmetrical to the axis of symmetry 1, is disposed opposite the passage opening 5 through anode shield 4. This anode shield is composed of two parts 31 and 32 made of a nonmagnetic material, e.g., material sold under the trademark Elconite. In order for the anode shield 4 to be able to withstand the high thermal stresses in the vicinity of the discharge axis, the nonmagnetic material must have good heat dissipating properties and also have a high melting point. For economical and practical reasons anode shield 4 is divided into the two parts 31 and 32, part 31 forming the holding ring and part 32 forming the interchangeable insert part which is subject to wear.

The surface of anode shield 4, particularly the surface 33 of interchangeable insert 32 which faces into the interior of gas discharge chamber 11, is planar and perpendicular to the axis of symmetry 1 while part 34, which is disposed opposite extraction electrode 28 and its passage opening 30, forms a cup about passage opening 5. Passage opening 5 could have a conical recess (not shown) on its side facing toward discharge chamber 11 so that the length of the channel is reduced and the effective cooling surface is enlarged.

Anode shield 4, and particularly part 32, is water cooled. The cooling by water is effected via inlet 35 in magnetic yoke 17, a radial bore 36 leading to an annular recess 37 which is formed in part in the bottom face 38 of magnetic yoke part 17 and in anode part 32.

The anode shield 4, or its two parts 31 and 32, respectively, are sealed by means of O rings 39, 40 and 41 with respect to bottom 38 and with respect to each other. Additionally conduit 42 passes through magnetic yoke part 17 to conduct gas to discharge chamber 11. Magnetic yoke parts 16 and 17 are sealed, by means of seals 43 and 44, relative to insulating disc 21.

Establishment of a so-called balanced operation, in which the cathode emission is set so that the potential difference between cathode 14 and intermediate electrode 2, 20 disappears, offers the advantage of increasing the life of cathode 14. If a material which is a good emitter of secondary electrons is selected for intermediate electrode sleeve 20, the actual cathode 14 is even more protected without adverse influence on the discharge in the gas discharge chamber 11.

The application of the above-mentioned higher voltage thus, in contrast to known arrangements, no longer leads to the occurrence of instabilities because the significant increase in the magnetic flux density B stabilizes the discharge process. The thus resulting increased energy density is not too great for the anode shield structure 4, 31, 32 according to the invention. With pulsed discharge, the pulse energy can significantly exceed the limit value for continuous sweep operation so that the proportion of highly charged ions in the plasma can be further increased.

Figure 4:
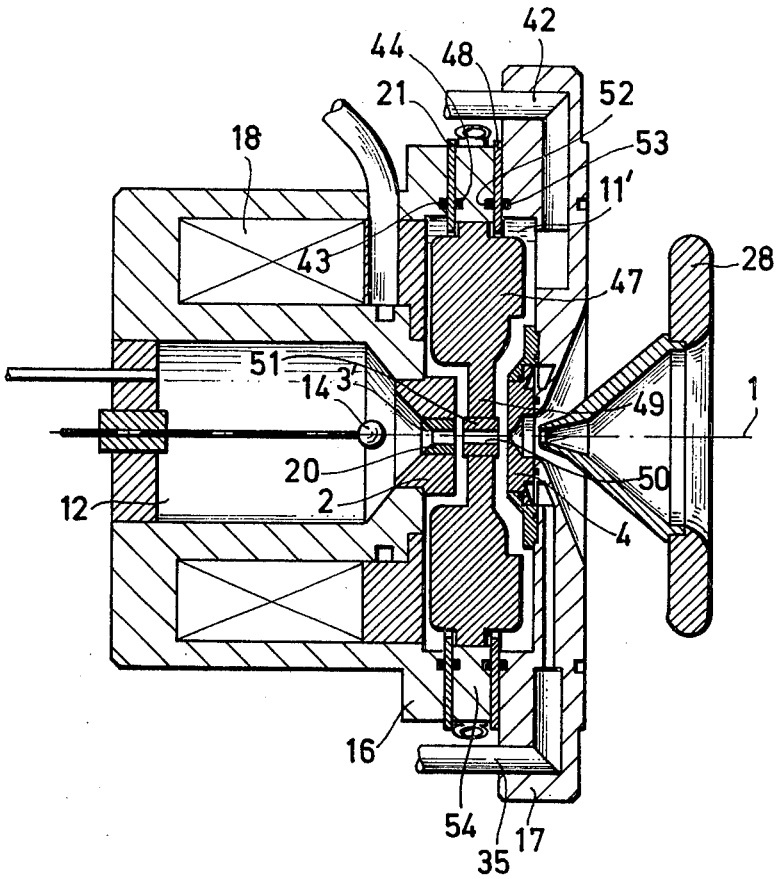
FIG. 4 is a view similar to that of FIG. 3 of an embodiment of the invention with a sputter electrode.

With this source, as well as with the source shown in FIG. 4, ion radiation with a high specific charge of about 0.05 $e_o/M_o$ can be produced uniformly for about 20 hours of operation. The lifetime of the source is limited by the fact that with high discharging energy the extraction opening 5 in the anode shield 4 becomes enlarged to such an extent after a certain period of use that the extracted beam can no longer be controlled ion-optically.

Examples of measured ion currents are presented in the following table:

| Element | Keying Ratio % | Ion Current, μA | Charge State 1 | 2 | 3 | 4 | 5 | 6 | 7 | 8 | 9 | 10 | 11 |
|---|---|---|---|---|---|---|---|---|---|---|---|---|---|
| Xe | 25% | During pulse, $I_\pi$ | 100 | 200 | 180 | 160 | 125 | 129 | 95 | 87 | 25 | 2.6 | ~0.3 |
| Ar | 10% | During pulse, $I_\pi$ | 500 | 1200 | 300 | 30 | 1 | | | | | | |
| Ti | 100% | Continuous, I | 8.2 | 33 | 13 | | | | | | | | |

The constant ion current I was plotted for titanium and pulsed ion current $I_\pi$ for xenon and argon. The maximum magnetic flux density was about 2 kG.

Operating substances employed for the source are noble gases and nitrogen. Gaseous compounds and vapors or one of their components, respectively, are often corrosive, particularly for the hot cathode 14. By introducing a protective gas through inlet 15 into cathode chamber 12 and introducing the corrosive operating gas through inlet 42 into discharge chamber 11, cathode 14 is dependably protected against corrosion.

By means of the ion atomization, or sputtering, technique, it is possible to obtain free atoms from all solids. For this purpose, the embodiment of the invention shown in FIG. 4 incorporates the structure shown in FIG. 2 and has a sputter electrode in the interior of discharge chamber 11' in addition to the intermediate electrode 2, 20 and the anode shield 4. Cathode chamber 12 with its cathode 14, coil 18, magnetic yoke parts 16 and 17 and extraction electrode 28, remain the same as in FIG. 3. For reasons of clarity the other reference numerals are therefore not repeated in FIG. 4.

By means of the annular sputter electrode 47, charged ions of solid substances can be produced. The sputter electrode is suitably designed to assure that the occurrence of ancillary discharges will not bring vapors into contact with the insulation disc 21 and with additional insulation disc 48, which would drastically reduce the period of operation.

Electrode 47 occupies almost the entire available space in the discharge chamber 11. However, it does have a thinner portion 49 between the intermediate electrode insert 2 and the anode shield 4. A cylindrical pipe 51 of the material to be sputtered is placed around the axis of symmetry 1, i.e., about the passage opening 50 of sputter electrode 47, 49. Sputter electrode 47, 49 itself is made of nonmagnetic material. However, it is enclosed by, or held by, a ring 54 which is disposed between insulating discs 21 and 48. Ring 54 is made of magnetic material and forms part of the magnetic yoke of the source. Insulating discs 21 and 48 and the associated seals 43, 44 and 52, 53 electrically insulate the individual parts 16, 17 and 54 from one another.

The deposition of atoms of the material to be sputtered on cold parts at the interior of chamber 11' is prevented substantially by the provision of a sputter cylinder 51 which is as long as possible. Further savings can be achieved if the sputter material is applied in opening 50 in the form of a thin layer, possibly by vapor deposition, electroplating or electrolytically. In this way it is possible to use even the most expensive materials such as enriched isotopes.

In this embodiment, the passage opening 3' of the intermediate electrode 2, 20 is a bit larger than in the embodiment of FIGS. 1 and 3.

In the case of pulsed discharge, the voltage across sputter electrode 47, 49, 51 is advisably pulsed also. In this connection it is advantageous to switch on the sputter pulse with a delay with respect to the main discharge pulse and to cut off the sputter pulse before the main discharge pulse.

Figure 5:
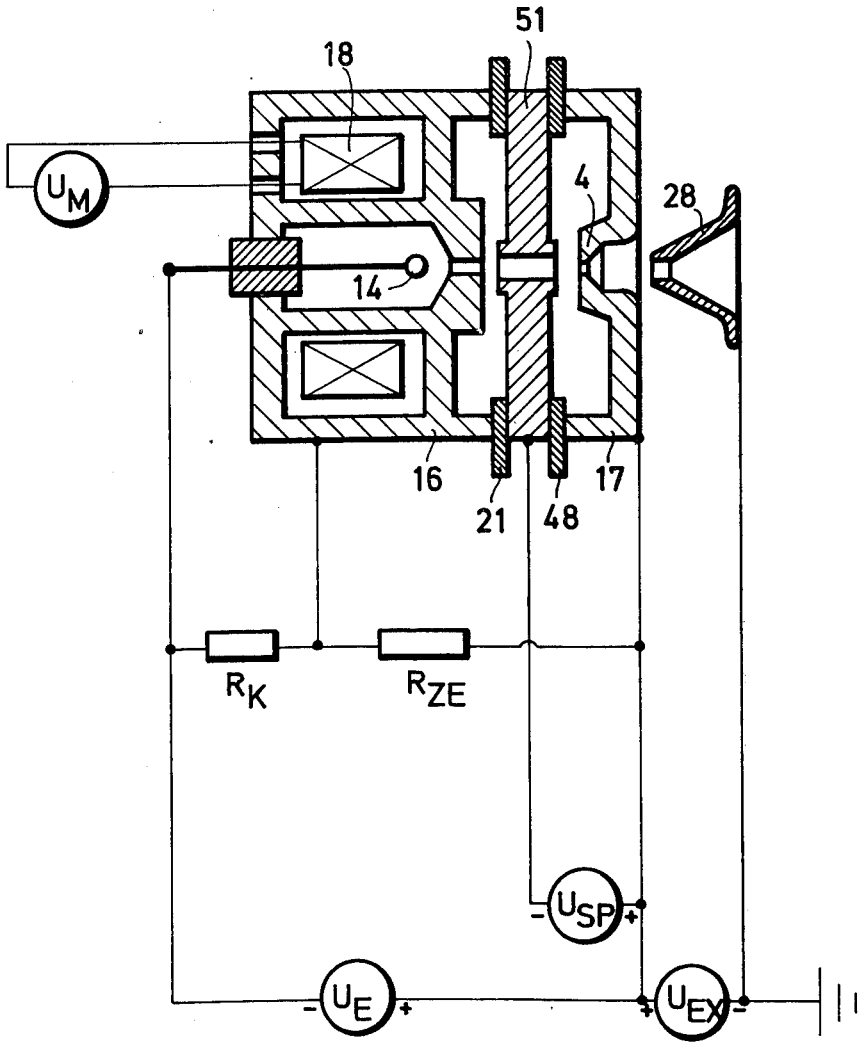
FIG. 5 is a diagram illustrating the electrical circuit of the embodiment shown in FIG. 4.

The electrical circuitry for the embodiment of FIG. 4 is shown schematically in FIG. 5. For reasons of simplicity only cathode 14, magnetic yoke parts 16, 17, extraction electrode 28 and insulating discs 21 and 48 with sputter electrode 51 are specifically identified. In the ordinary embodiment shown in FIG. 3, the sputter electrode 51 and its voltage supply $U_{SP}$, typically having a value of 300 V, would be eliminated. The extraction voltage $U_{EX}$ is applied between extraction electrode 28 and magnetic yoke part 17 or anode shield 4, respectively. Typically it has a value of 35 kV. The discharge voltage $U_E$ is applied between the magnetic yoke part 17 and cathode 14 and has a value of about 200 V.

The magnetic yoke part 16 is connected to cathode 14 and anode 4, 17 by means of resistors $R_K$ and $R_{ZE}$ and respectively constituting a voltage divider. The value of resistor $R_{ZE}$ is 1 kOhm for direct current operation and 100 Ohms for pulsed operation. In direct current operation, resistor $R_K$ can be eliminated. In pulsed operation it has a value of 10 Ohms. $U_M$ is the supply voltage for magnetic coil 18 whose maximum magnetic flux density is about 2 kG. The supply voltage $U_{SP}$ for the sputter electrode 51 is connected between it and anode 17, the negative pole being at the sputter electrode. Voltage supply $U_{EX}$ has its negative pole connected to ground.

The opening 5 in the anode shield 4 must lie in the maximum axial magnetic field intensity region, but not in the marginal regions with steeply increasing or decreasing axial magnetic field. This is achieved by means of a suitably shaped anode shield 4 of nonferromagnetic material.

The intermediate insert 20 could be made of e.g. titanium or tantalum.

It will be understood that the above description of the present invention is susceptible to various modifications, changes and adaptations, and the same are intended to be comprehended within the meaning and range of equivalents of the appended claims.

What is claimed is:

1. In a charged ion generating source composed of a glow cathode, an intermediate electrode and an anode electrode having a common axis of symmetry, each electrode being provided with an opening constituting an axial passage extending along the common axis of symmetry, means defining a discharge chamber bordered by the electrodes and in which electrons and/or auxiliary gas ions form the charged ions, and a system composed of a coil and a magnetic yoke for producing a magnetic field having an axial component along the common axis of symmetry, the improvement wherein said axial passage of said opening of said anode electrode is located in a region where the magnitude of the axial component of the flux density of the magnetic field is close to the maximum value of that component.

2. An arrangement as defined in claim 1 wherein said anode electrode comprises an anode shield of nonmagnetic material in which said anode electrode opening is provided.

3. An arrangement as defined in claim 2 wherein said anode shield is constructed to be coolable.

4. An arrangement as defined in claim 2 wherein said anode shield is composed of at least two parts and is replaceable in said anode electrode.

5. An arrangement as defined in claim 1 wherein said intermediate electrode comprises a cylinder of a high melting point, nonmagnetic material in which said intermediate electrode opening is provided.

6. An arrangement as defined in claim 1 further comprising a sputter electrode of nonmagnetic material fastened to said magnetic yoke and disposed in said discharge chamber between said intermediate electrode and said anode electrode, said sputter electrode including a cylinder of material to be sputtered provided with an opening constituting an axial passage extending along said common axis of symmetry.

7. An arrangement as defined in claim 6 wherein said sputter electrode is configured to fill a major portion of said discharge chamber.

8. An arrangement as defined in claim 7 wherein said sputter electrode comprises an outer ring which forms a part of said magnetic yoke and further comprising insulating discs electrically insulating said sputter electrode from said intermediate electrode and from said anode electrode.

9. An arrangement as defined in claim 2 wherein said intermediate electrode comprises a cylinder of a high melting point, nonmagnetic material in which said intermediate electrode opening is provided.

10. An arrangement as defined in claim 9 wherein said yoke includes only one magnetic circuit.

* * * * *